US007219738B2

(12) United States Patent
Reimert

(10) Patent No.: US 7,219,738 B2
(45) Date of Patent: May 22, 2007

(54) INNER RISER ADJUSTABLE HANGER AND SEAL ASSEMBLY

(75) Inventor: Larry E Reimert, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 136 days.

(21) Appl. No.: 10/527,828

(22) PCT Filed: Sep. 17, 2003

(86) PCT No.: PCT/US03/29650

§ 371 (c)(1),
(2), (4) Date: Mar. 15, 2005

(87) PCT Pub. No.: WO2004/027202

PCT Pub. Date: Apr. 1, 2004

(65) Prior Publication Data

US 2006/0011347 A1 Jan. 19, 2006

Related U.S. Application Data

(60) Provisional application No. 60/411,176, filed on Sep. 17, 2002.

(51) Int. Cl.
*E21B 29/12* (2006.01)

(52) U.S. Cl. ..... 166/348; 166/378; 166/208; 166/382

(58) Field of Classification Search ..... 166/348, 166/368, 378, 208, 212, 381, 382, 75.14, 166/367

See application file for complete search history.

(56) References Cited

U.S. PATENT DOCUMENTS

| | | | |
|---|---|---|---|
| 1,546,305 | A | 7/1925 | Newton |
| 1,696,844 | A | 12/1928 | Haynes et al. |
| 2,228,505 | A | 1/1941 | Carter et al. |
| 2,660,248 | A | 11/1953 | Brown |
| 2,897,895 | A | 8/1959 | Ortloff |
| 3,011,552 | A | 12/1961 | Rhodes et al. |
| 3,104,708 | A | 9/1963 | Orr et al. |

(Continued)

OTHER PUBLICATIONS

OTC Publication 4576, Bunell et. al., Satellite Tree Subsea Completions Permit Marginal Reserves Production Offshore East Kalimantan, Indonesia, 1983 Offshore Technology Conference.

(Continued)

*Primary Examiner*—Thomas A Beach
(74) *Attorney, Agent, or Firm*—Browning Bushman P.C.

(57) ABSTRACT

An inner riser adjustable hanger and seal assembly are provided for applying tension to a casing string secured at a lower end within a well and supported at an upper end by a wellhead housing. The wellhead housing has a locking member on an inner surface thereof. A tensioning mechanism tensions the casing string and secures the upper end to the wellhead housing. A seal body locking member is radially moveable into engagement with the housing locking member to fix the axial position of the seal body relative to the wellhead housing. An upper seal assembly seals between the seal body and the wellhead housing, and a lower assembly seals between the seal body and the casing string. The casing string is tensioned without appreciable rotation of the hanger body or the upper and lower seal assemblies.

29 Claims, 7 Drawing Sheets

U.S. PATENT DOCUMENTS

| | | | | | |
|---|---|---|---|---|---|
| 3,581,817 | A | | 6/1971 | Kammerer | |
| 3,690,344 | A | | 9/1972 | Brumm | |
| 3,721,292 | A | | 3/1973 | Ahlstone | |
| 3,861,463 | A | | 1/1975 | Crowe | |
| 3,933,376 | A | | 1/1976 | Cugini | |
| 3,976,139 | A | | 8/1976 | Wilder | |
| 4,258,795 | A | | 3/1981 | Hansen | |
| 4,280,719 | A | | 7/1981 | Daniel et al. | |
| 4,343,495 | A | | 8/1982 | Nobileau et al. | |
| 4,408,783 | A | | 10/1983 | Gruller | |
| 4,433,725 | A | | 2/1984 | Bowyer | |
| 4,465,134 | A | | 8/1984 | Watkins | |
| 4,519,633 | A | | 5/1985 | Nichols | |
| 4,653,589 | A | | 3/1987 | Alandy | |
| 4,674,576 | A | | 6/1987 | Goris et al. | |
| 4,836,278 | A | * | 6/1989 | Stone et al. | 166/115 |
| 4,919,454 | A | | 4/1990 | Caulfield et al. | |
| 4,938,289 | A | | 7/1990 | Van Bilderbeek | |
| 4,995,464 | A | | 2/1991 | Watkins et al. | |
| RE34,071 | E | | 9/1992 | Van Bilderbeek | |
| 5,299,642 | A | * | 4/1994 | Nelson et al. | 166/368 |
| 5,330,002 | A | * | 7/1994 | Saunders | 166/208 |
| 5,566,761 | A | | 10/1996 | Pallini, Jr. et al. | |
| 5,725,056 | A | * | 3/1998 | Thomson | 166/382 |
| 5,839,512 | A | | 11/1998 | Malone et al. | |
| 5,944,111 | A | | 8/1999 | Bridges | |
| 6,065,542 | A | | 5/2000 | Lalor et al. | |
| 6,202,745 | B1 | * | 3/2001 | Reimert et al. | 166/115 |
| 6,516,887 | B2 | * | 2/2003 | Nguyen et al. | 166/348 |
| 2001/0045286 | A1 | | 11/2001 | Pallini et al. | |
| 2002/0100596 | A1 | | 8/2002 | Nguyen et al. | |

OTHER PUBLICATIONS www.vetcogray.com, Adjustable Drilling Riser System, 2004.

* cited by examiner

INNER RISER ADJUSTABLE HANGER AND SEAL ASSEMBLY

RELATED CASE

This application claims priority from U.S. application Ser. No. 60/411,176, filed Sep. 17, 2002.

FIELD OF THE INVENTION

The present invention relates to adjustable hangers for use in downhole wells, and more particularly to an inner riser adjustable hanger.

BACKGROUND OF THE INVENTION

In applications such as spars, it is often desired to pull and maintain tension in the production casing when tying-back to the wellhead at the ocean floor. When tying-back the casing to the surface, the casing needs to be in tension due to fatigue, buckling, thermal growth, etc. To put the casing in tension requires that it be tensioned and locked at the surface wellhead.

A selected tensioning mechanism and method may be used to apply tension between the casing and the surface wellhead. When dealing with heavy casing over long distances, the casing tends to stretch. Since the exact amount of casing length stretch and the initial length are difficult to determine, it is desirable to compensate for this distance by an adjustable load bearing tensioning mechanism. In many spar applications, the tensioning mechanism has an axial stretch length of 3 meters or more. Various types of sealing mechanisms cooperate with the tensioning mechanism to seal between the upper end of the tensioned casing and the wellhead.

Prior patents relating to downhole adjustable hangers and particularly to an inner riser adjustable hanger are U.S. Pat. Nos. 5,566,761; 5,944,111; 4,519,633; 6,328,108; RE34,071; 4,938,289; 4,408,783; 4,465,134; 1,546,305; 3,721,292; 4,653,589; 2,660,248; 3,104,708; 3,581,817; 3,690,344; 3,976,139; 2,897,895; 3,011,552; 3,933,376; 4,343,495; 4,674,576; 4,280,719; 4,258,795; 3,861,463; 3,721,292; 1,696,844; 5,299,642; 4,919,454; 6,065,542; 2,228,505; 5,839,512; 4,433,725; and 4,995,464; OTC paper 4576; Adjustable Drilling Riser brochure from ABB Vetco Gray; Publication No. 20010045286; and Publication No. 20020100596.

While various types and styles of inner riser adjustable hangers have been provided to the hydrocarbon recovery industry, prior art inner riser adjustable hangers have significant disadvantages which have limited their acceptance. Those disadvantages include high costs and poor reliability of the sealing mechanism. Many adjustable hangers require rotation of either an inner string or an outer tubular, and in many applications rotation of a string or other tubular at the surface, particularly under conditions where that tubular is subject to high tension and/or rapid changes in tension, are undesirable for the well operator, and in turn may require more costly surface equipment.

The disadvantages of the prior art are overcome by the present invention, and the inner riser adjustable hanger and seal assembly is hereinafter disclosed. The invention also involves a method of maintaining a desired tension in a casing string, and thereafter running in a sealing assembly for sealing between the wellhead and the tensioned casing string.

SUMMARY OF THE INVENTION

A preferred adjustable hanger and seal assembly for applying tension to a casing string includes an outer housing or wellhead, a tensioning mechanism, a seal body, an upper and a lower seal assembly, and in a particularly preferred embodiment a C-ring for fixing the seal body to the wellhead housing. The casing string is secured at a lower end within a well and is supported at the upper end by the wellhead housing, with tensioning forces being transmitted through the tensioning mechanism, which may set the desired tension in the casing string at a selected set position along the length of the tensioning mechanism. The seal body carrying the lower seal assembly and a setting sleeve is subsequently lowered into position with respect to the wellhead, and is then secured in position above the upper end of the casing string. In one embodiment, the preferred C-ring moves radially within a locking groove to fix the axial position of the seal body relative to the wellhead housing. The upper seal assembly may then be run into the well, and seals between the seal body and an inner surface of the wellhead housing, while the lower seal assembly seals between the seal body and the casing string.

It is an object of the present invention to improve the reliability of an inner riser adjustable hanger by providing a highly reliable tensioning mechanism that sets the desired tension in the casing string, with the operability of that tensioning mechanism not being affected by a seal assembly. After the tensioning mechanism has applied the desired tension to the casing string, a seal housing with a lower seal assembly may be run in the well to provide a highly reliable seal between the seal body and the tensioned casing string. The upper seal assembly may then be run into the well to seal between the seal body and the wellhead. The present invention allows for the use of highly reliable seals with few moving parts since the axial adjustment provided by the tensioning mechanism has preferably occurred before these seals are set.

It is a feature of a preferred embodiment of the invention that the seal body may be axially secured to the wellhead housing by a C-ring, so that the seal body may land on a surface of the wellhead housing and then be axially secured thereto by the reliability of the C-ring.

It is also a feature of the present invention that a support ring may be axially moveable relative to the C-ring for preventing the expanded C-ring from collapsing and moving out from the locking groove in the wellhead housing. It is a further feature of the invention that the C-ring is carried on the seal body and is biased radially outward.

Yet another feature of the invention is the inclusion of a centralizer ring for centralizing the lower end of the seal body relative to the wellhead casing string.

A further feature of the invention is the combination of a detent ring and shear pins to set the lower seal assembly. A plurality of buttons may be used to move the detent ring radially inward, which allows a force to then be transmitted to shear the shear pins and set the lower seal assembly between the seal body and the casing string.

These and further objects, features, and advantages of the present invention will become apparent from the following detailed description, wherein reference is made to the figures in the accompanying drawings.

DETAILED DESCRIPTION OF PREFERRED EMBODIMENTS

Figure 2:
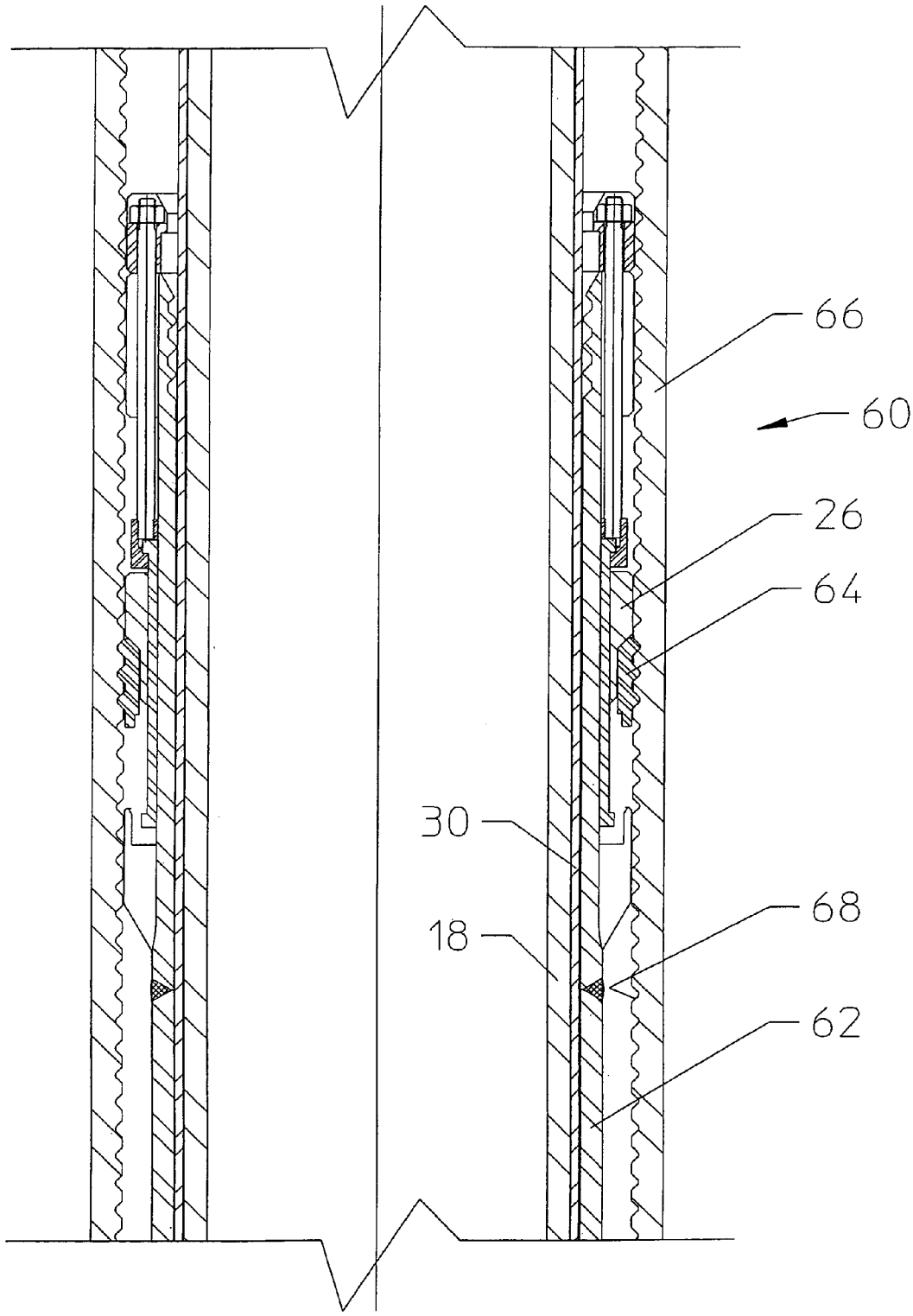

An inner riser adjustable hanger and seal assembly 10 according to the present invention provides a mechanism for pulling tension in a casing 20 (see FIG. 3) positioned within a production riser (not shown) by using a tensioning mechanism 60, as shown in FIG. 2. The wellhead housing 12 may include multiple housing locking members 14 or other locking members which allow various styles and types of bodies to land out and be reliably secured to the wellhead housing 12. An upper seal assembly 16 (see FIG. 4) is configured to energize and seal off the annulus between the seal body 18 and wellhead housing 12. The seal body 18 is captured in place by a seal body locking member 24, such as split lock ring 24, activated to move radially outward into a respective housing locking member 14 in the housing 12, with seal assembly 16 energized.

The housing locking member 14 may be a plurality of axially spaced grooves, in which case the seal body locking member 24 as discussed is preferably a "C-ring" or "split ring" having a plurality of radially projecting dogs. In other embodiments, the housing locking members 24 may be radially inward portions of a threaded section, in which case the seal body locking member 24 is preferably a threaded member. The housing locking member 14 may be welded or otherwise secured to a conventional wellhead housing. Below the locking member 14, an outer tubular or riser is conventionally secured in a well. In a suitable embodiment, the wellhead housing locking member is secured by tubular 66 to the wellhead housing.

Figure 3:
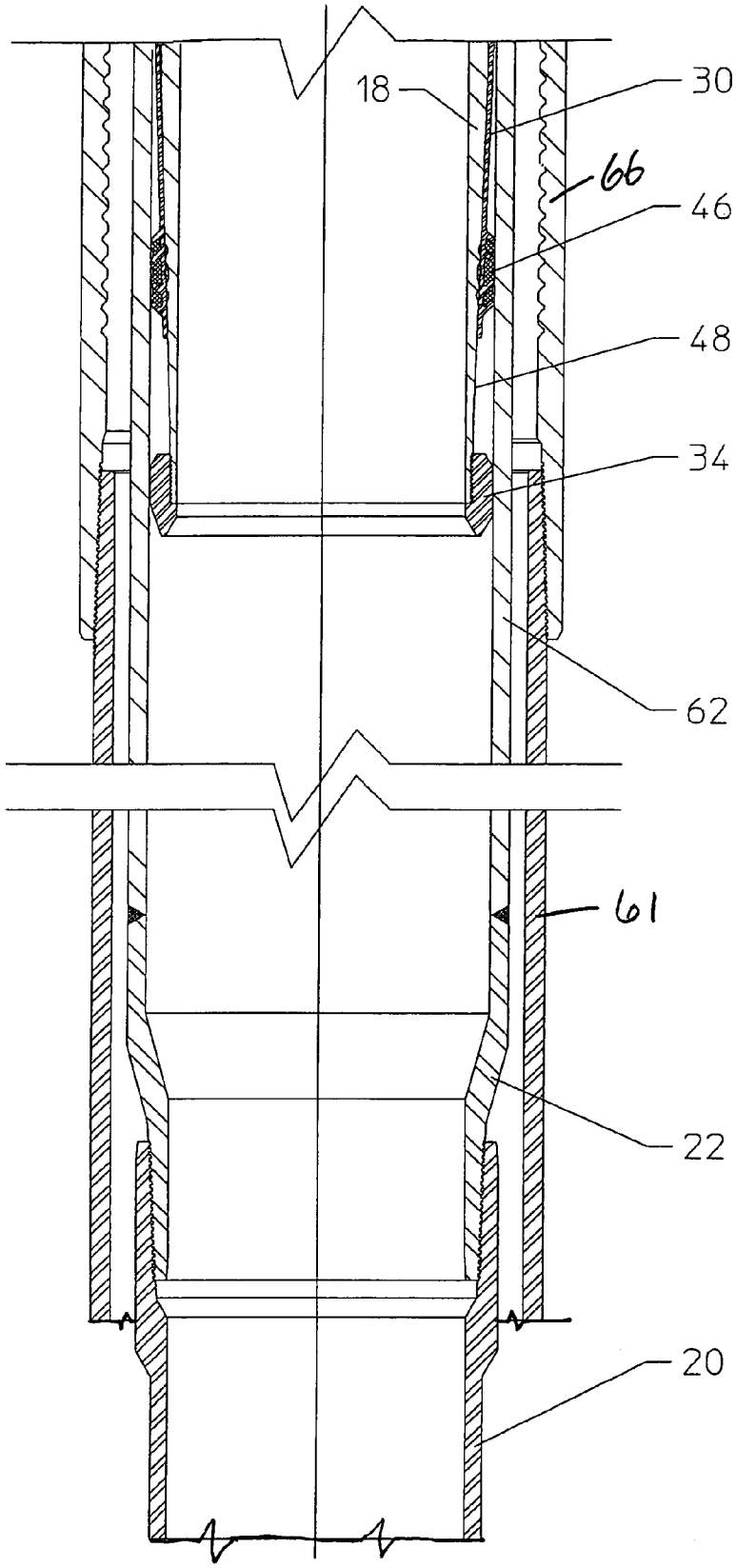

In a conventional manner, the string of casing 20 as shown in FIG. 3 extends down below the wellhead housing 12. At the lower end of the inner tensioning sleeve 62 is a pin connection 22 that is threadably attached to the box end of the casing string 20, so that the casing string 20 is tied-off to the inner tensioning sleeve 62, which in turn is axially fixed by C-ring 64 (FIG. 2) to an outer sleeve 66. The sleeve 66 is secured to the wellhead housing 12, such as by welding as an extension. An outer riser 61 is threadably secured from below to the sleeve 62. The axially spaced grooves 68 along the inner surface of the sleeve 66 provide for engagement with the C-ring 64. The upper end of the wellhead housing 12 may include a connector profile 13 (see FIG. 1) for interconnection to upper equipment indicated generally at 21, e.g. a BOP, a tree, or a spool housing. C-ring 24 is supported on the upper end of the seal body 18, and functions as the locking mechanism for the seal body 18 to the wellhead housing 12. As explained subsequently, the seal body 18 and lower seal assembly 46 carried thereon (see FIG. 4) are preferably run in the well with a running tool after the casing string 20 and tensioning mechanism 60 are run in, and after the casing string 20 is tensioned to the desired degree.

Figure 5:
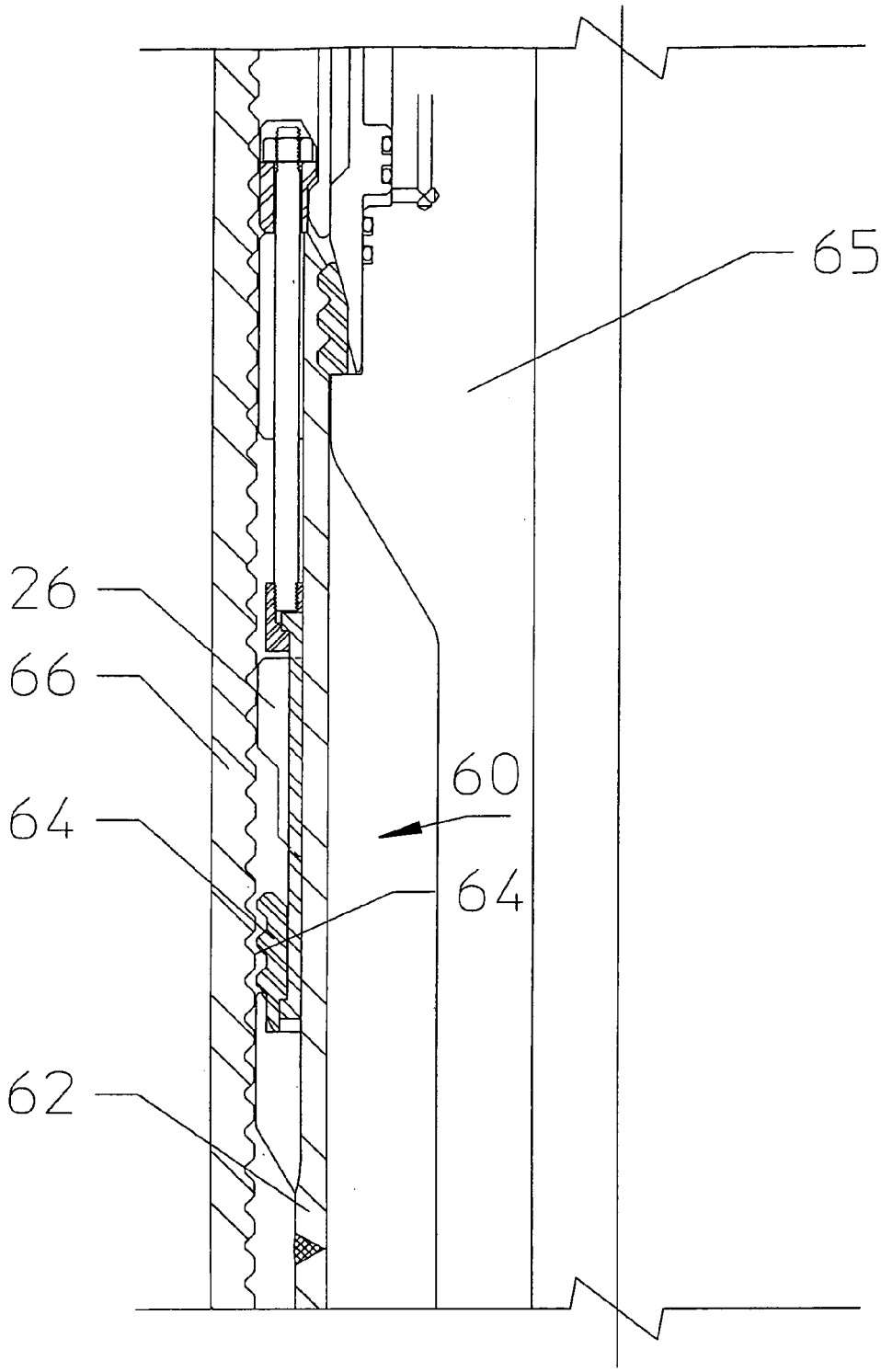
FIG. 5 depicts in greater detail the left side the tensioning mechanism shown in FIG. 2 in the run-in position.
Figure 6:
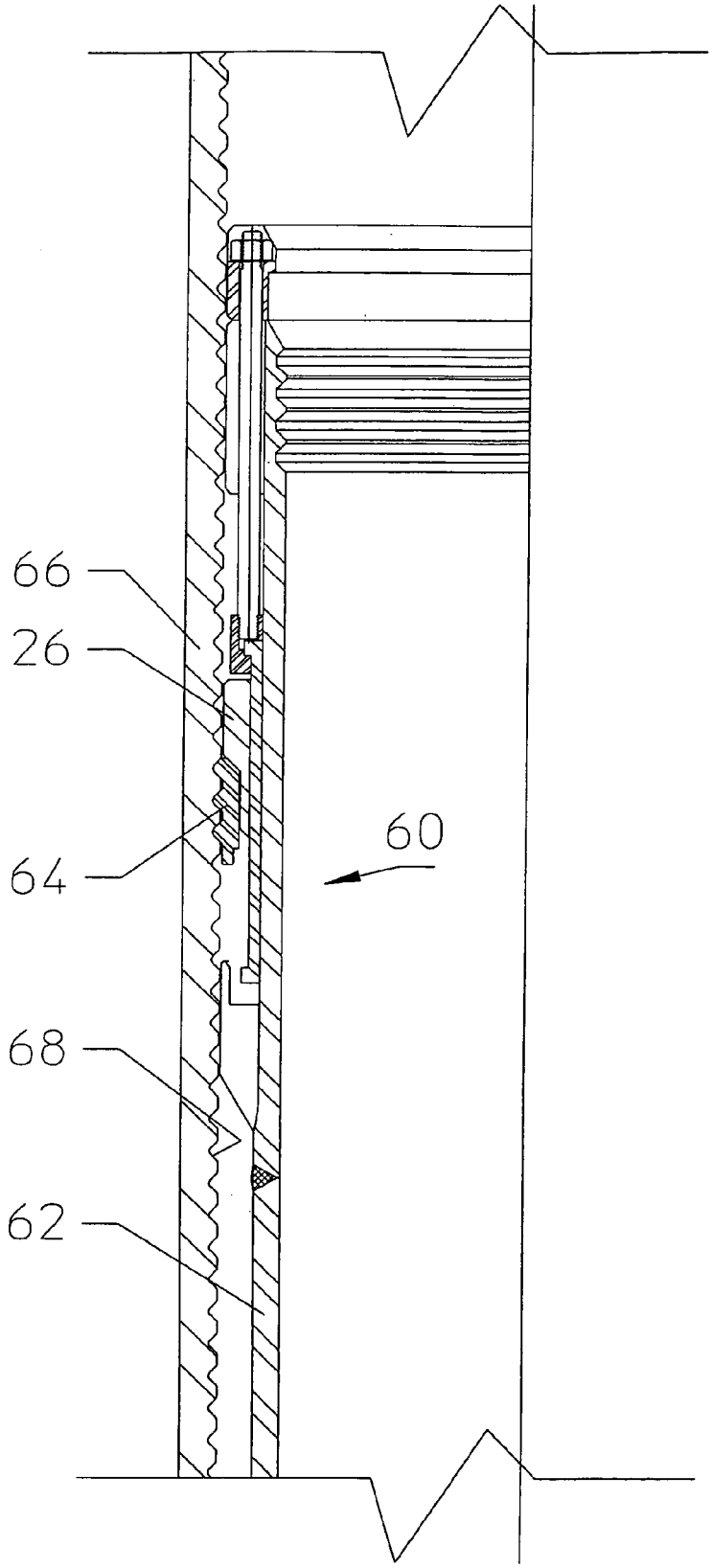
FIG. 6 depicts in greater detail the right side of the tensioning mechanism in the set position prior to running the sealing mechanism in the well.
Figure 7:
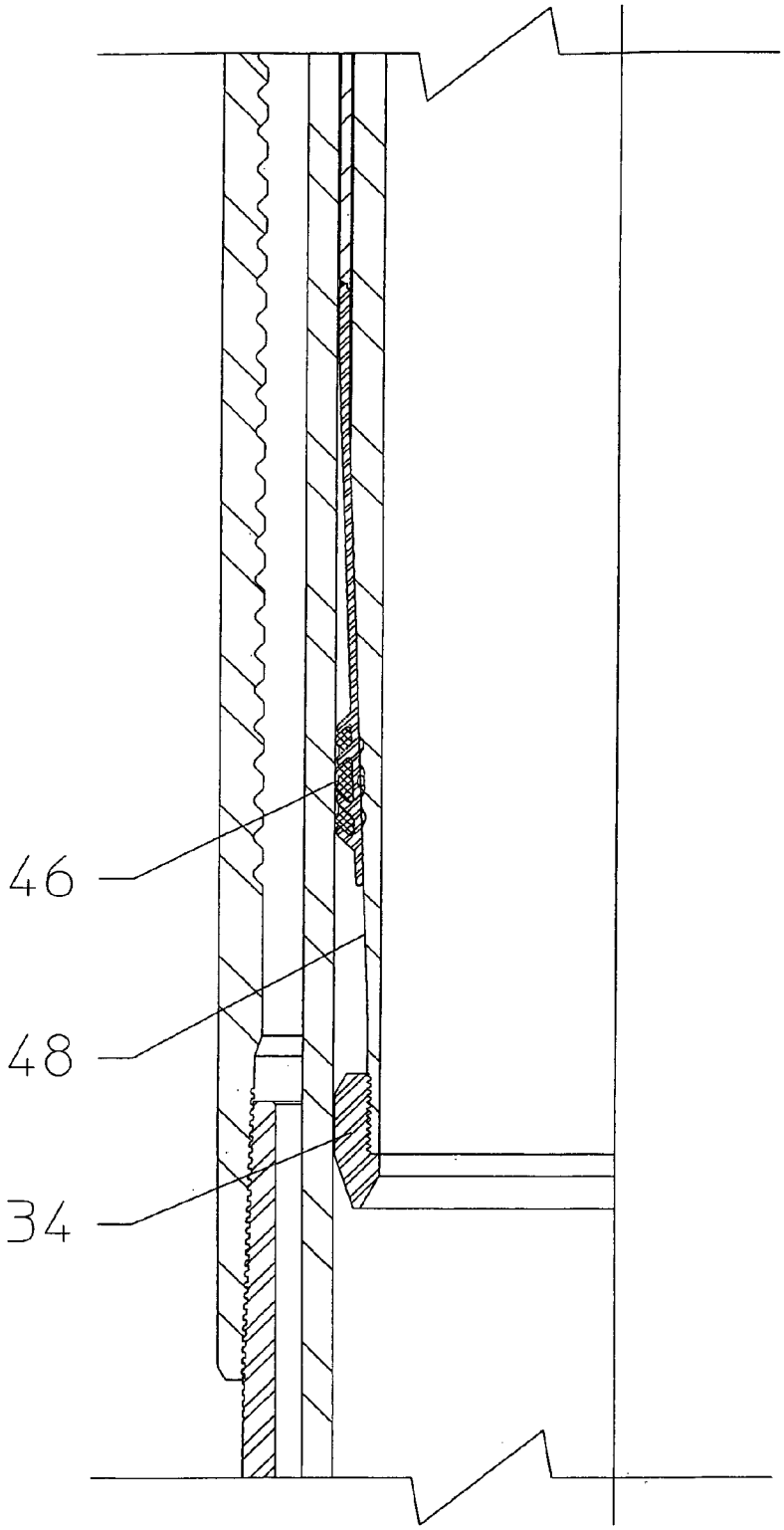
FIG. 7 is a half sectional view depicting in greater detail the lower portion of the wellhead housing with the lower seal assembly between the seal body and the upper end of the casing string.

Because the bottom of the casing string 20 is tied-off using various slips, hangers, or cement, upward movement of the running tool when interconnected with the top of the casing string pulls tension on the casing string 20. The tensioned casing is set utilizing a running tool 65 in the known manner as shown in FIG. 5. After the desired tension in the casing string 20 is thus reached, the C-ring 64 (see FIG. 2) springs radially outwardly into a selected one of the grooves 68 in the outer tensioning sleeve 66, which is fixed to the wellhead housing 12. To prevent the split ring 64 from collapsing radially inwardly and unlocking, the running tool 65 slacks off and energizes a support ring 26 that includes portions which move radially inward of and axially aligned with the split ring 64 (i.e. between the split ring 64 and the tensioning sleeve 62) to maintain the split ring in its radially outward position. The support ring 26 may include circumferentially spaced, downwardly projecting fingers, because a circumferentially complete or full support ring is not required. The entire casing string 20 is now completely landed and in tension. Most importantly, the casing string 20 has been tensioned to the desired amount, which is very important to the reliability of the threaded connections in the casing joints. Furthermore, the desired tension is obtained without rotating either the casing string 20 or the wellhead housing 12. This feature allows tension to be pulled in the casing string 20 with the casing string 20 locked in place without the necessity of any component rotation. A set casing string fixed in tension by the tensioning mechanism 60 is illustrated in FIG. 6 prior to running the seal body 18 in the well.

Figure 4:
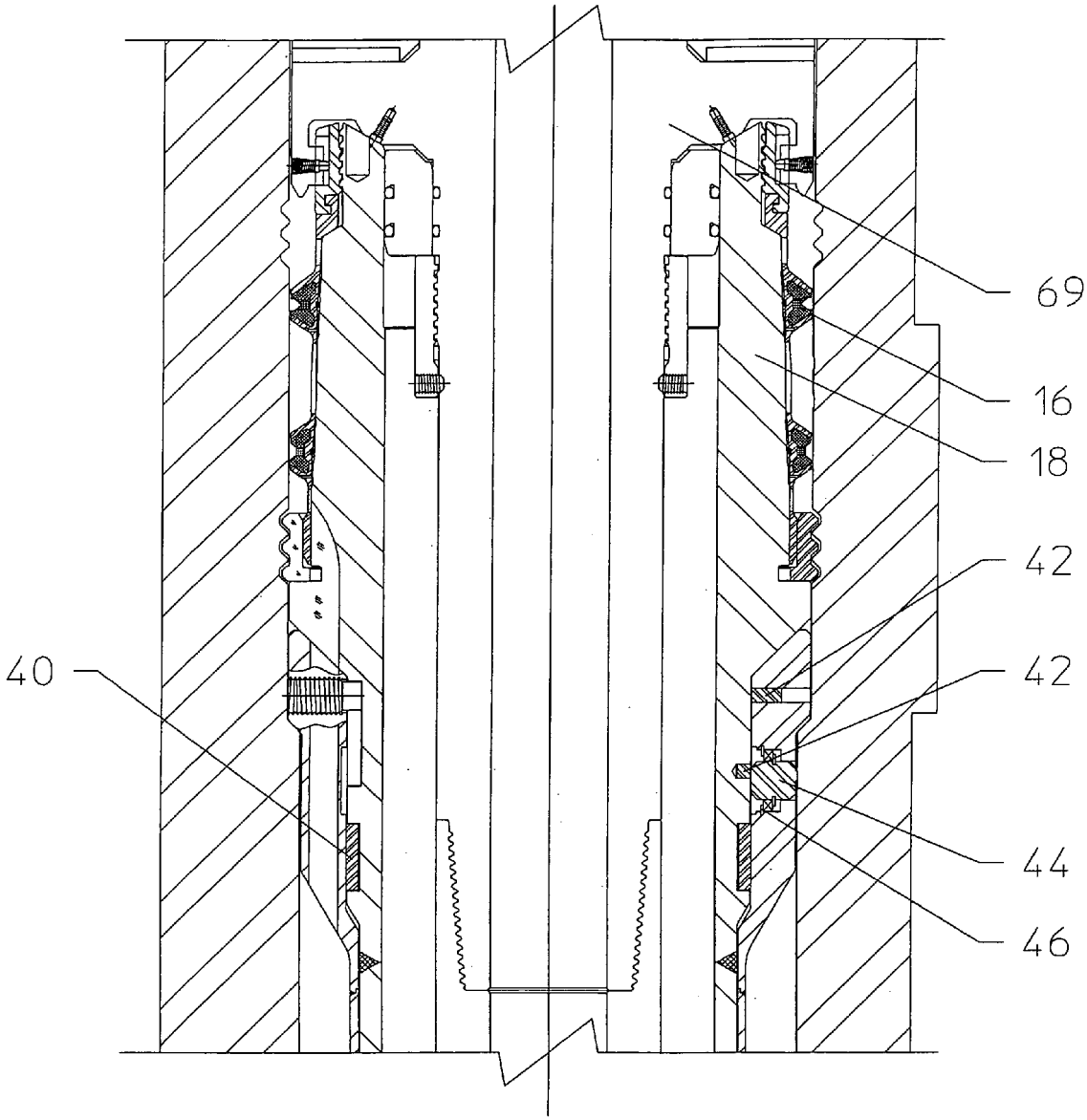
FIG. 4 is a sectional view depicting in greater detail the landed seal body.

After the first running string and running tool 65 are retrieved, the annulus between the seal body 18 and the casing string 20 is sealed by seal assembly 46. A second running tool 67 carrying the seal body 18 and the seal assembly 46 below it may then be run in the well (see FIGS. 1 and 3). A setting sleeve 30 supports the seal assembly 46 and is landed on load shoulder 32 of the housing 12. The seal assembly 46 is protected by a centralizing ring 34 located at the lower end of the seal hanger body 18. It is critical that the seal assembly 46 energize at the proper time. If the seal assembly 46 were to engage prematurely, it could become damaged and thereafter adversely affect sealing reliability and capability. To prevent premature energization, a detent ring 40 (see FIG. 4) is supported on the seal hanger body 18, with the setting sleeve 30 being fixed to the seal body 18 by one or more circumferentially spaced shear pins 42. The number and size of the shear pins is a function of the limitations of the housing load shoulder 32. The seal body 18 is thus set above the tensioning mechanism 60, with movement of the setting sleeve 30 relative to the housing 18 controlled by the action of the shear pins 42 and the detent ring 40. The seal body 18, the setting sleeve 30, and the lower seal assembly 46 are thus preferably run in together on running tool 67 after the casing string 20 is tensioned. When the setting sleeve 30 reaches the load shoulder 32 on the outer housing 12, buttons 44 biased outwardly by springs (not shown) are pushed radially inward, thereby radially collapsing the detent ring 40 to the position shown in FIG. 4. This then allows the shear pins 42 to shear as shown in FIG. 4 upon a selected load applied by the running string through the running tool 67, so that the setting sleeve 30 may land out on the seal hanger body 18 and continue downward to set the seal assembly 46 between the seal body 18 and the inner tensioning sleeve 62, which is an extension of the casing string 20.

In a preferred embodiment, the outer surface 48 of the seal body 18 is tapered, so that axial movement between the seal body and the seal assembly 46 results in setting the seal assembly to reliably seal between the upper end of the casing string 20 and the lower end of the seal body 18. In an alternate embodiment, an outer surface of the upper end of the casing string 20 could be tapered to achieve a similar result.

Figure 1:
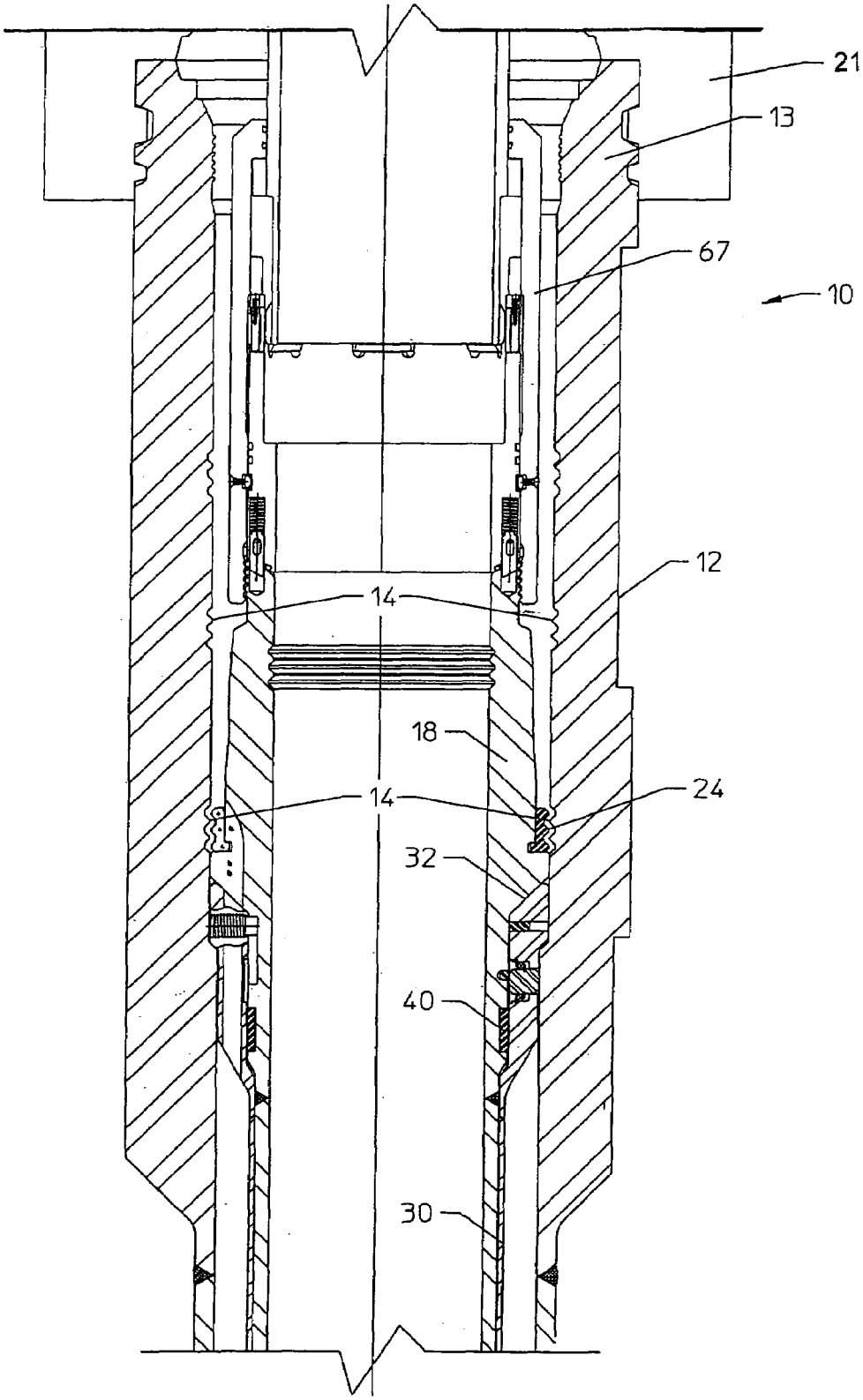
FIGS. 1, 2, and 3 together depict one embodiment of an inner riser adjustable hanger and seal assembly, with the seal body shown in the landed position and the tensioning mechanism shown in the set or tensioned position.

After the seal body 18 has been fixed to the wellhead housing 12 and the lower seal assembly 46 is set, a third running tool 69 (see FIG. 4) may be used to lower the upper seal assembly 16 into the well. The third running tool 69 may thus be used to axially move the upper seal assembly 16 from a run-in position to the set position as shown in FIG. 1, so that the set seal assembly 16 reliably seals between the wellhead housing 12 and the seal body 18. The third running tool 69 may then be retrieved to the surface so that the combination inner riser adjustable hanger and a seal assembly 10 may be substantially as shown in FIGS. 12, and 3.

The inner riser adjustable hanger 10 of the present invention utilizes large diameter central flow passageways in the seal body 18 and the setting sleeve 30 to allow substantially full bore access to the annulus. More particularly, the diameter of the bores in 18 and 30 are each substantially equal to or greater than the diameter of the casing 20 suspended from the wellhead housing 12.

In an alternate embodiment, the upper seal assembly could be run in the well with the seal body 18, and in still further embodiments the upper seal assembly may be sealed between the seal body and the wellhead housing without requiring axial movement of the upper seal assembly between a run-in position and a set position. An O-ring seal between the seal body and the wellhead housing could thus be used, replacing the seal assembly and the need for a third running tool. A seal assembly 16 as disclosed herein that utilizes axial movement of the seal assembly relative to the wellhead housing is highly preferred, however, since this type of seal assembly provides a highly reliable and long term seal, which is generally not possible with an O-ring seal.

Various types of mechanisms may be used for tensioning the casing string. A preferred mechanism as disclosed herein uses a C-ring to move radially outward into a selected groove to lock the tension casing string to the wellhead housing. The C-ring may be activated, if desired, by a hydraulically powered setting mechanism within the running tool 65, which runs the tensioning mechanism 60 with the casing string 20 in the well. In an alternate embodiment, a ratchet mechanism may be used for tensioning the casing string and locking the tensioned casing string to the wellhead housing. Various techniques may also be used to effectively change the length of the tensioned casing string 20. A threaded nut may be lowered onto a shoulder fixed to the wellhead to change the tensioned length of the string, while in other embodiments an adjustment mechanism which includes rotatable components may be provided below the load bearing shoulder on the wellhead housing. In many applications, however, operators do not prefer to require rotation of a string, since extremely long and relatively expensive threads may be required to achieve the desired tension in the string, and since the threads may be subject to high load forces and galling. Moreover, the well operator typically prefers not to require rotation of a string at the surface, particularly when the string is subject to high tensile loads. The present invention provides both a tensioning mechanism and a sealing mechanism which do not require rotation of any tubular strings or components within the well.

In a preferred embodiment, the sealing assembly includes an upper sealing assembly which seals to an inner surface of the wellhead housing, and a lower sealing assembly which seals with an inner surface of the casing string. At least one of an upper proportion of the casing string and a lower portion of the seal body preferably includes a tapered surface, such that the lower sealing assembly is moved axially by a setting sleeve to the set position. The setting operation of the lower seal may be accomplished by various alternative techniques and will be apparent to those skilled in the art. As disclosed herein, a lower sealing assembly is preferably provided below the tensioning mechanism, which allows the seal body, the setting sleeve, and the lower seal assembly to be standard for all applications, so that the sealing mechanism will reliably seal the wellhead housing to the casing string regardless of the position of the tensioning mechanism.

The upper seal assembly 16 as shown in FIG. 4 is also preferably in the type which is moved from the run-in position to the set position by axial movement of the seal assembly with respect to the wellhead housing. As shown in FIG. 4, an outer surface of the seal body 18 is thus tapered to move the seal assembly 16 radially outward into sealing engagement with a cylindrical inner surface of the wellhead 12 when the sealing assembly is moved from the run-in position to the set position. In a less desired embodiment, the inner surface of the wellhead could be tapered to achieve substantially the same result. The known and fixed position of both the upper sealing assembly and the lower sealing assembly relative to the wellhead housing thus provides high reliability at a relatively low cost.

Those skilled in the art will appreciate that an operator may install the hanger with an upward pull to secure the hanger axially relative to the wellhead housing, then the seal body 18 and setting sleeve 30 positioned in place to serve their desired functions.

Axially spaced locking member are preferably provided on the wellhead housing and on the seal body. The wellhead housing locking member may be secured to the wellhead housing, and may take the form of axially spaced threads on the continuous groove or axially spaced locking grooves, as shown in the preferred embodiment. The cooperating locking member attached to the seal body may be a C-ring, as discussed above. In preferred embodiments, each of the wellhead housing locking member and the seal body locking member may be provided circumferentially about a bore of the housing and the OD of the seal body. The locking members preferably extend circumferentially about their respective supporting member. In preferred embodiments, the locking members cooperate to provide locking surfaces extending circumferentially about at least 200 degrees, and preferably about at least 270 degrees of the imaginary locking circle.

A feature of the invention is that the seals, and in particular the lower seal, need not rotate when the casing string is tensioned. This feature provides a significant advantage over most conventional hanger and seal assemblies of the prior art.

The foregoing disclosure and description of the invention is illustrative and explanatory of preferred embodiments. It would be appreciated by those skilled in the art that various changes in the size, shape of materials, as well in the details of the illustrated construction or combination of features discussed herein maybe made without departing from the spirit of the invention, which is defined by the following claims.

The invention claimed is:

1. An inner riser adjustable hanger and seal assembly for applying tension to a casing string secured at a lower end at a well and supported at an upper end by a wellhead housing, the hanger and seal assembly comprising:

the wellhead housing having a housing locking member on an inner surface thereof;

a tensioning mechanism for tensioning the casing string and securing the upper end of the tensioned casing string to the wellhead housing, the tensioning mechanism including a plurality of axially spaced tension members on an inner surface of a tensioning sleeve fixed to the wellhead housing, the tensioning mechanism axially connecting in tension the casing string to a selected one or more of the plurality of axially spaced tension members such that a desired tension is exerted on the casing string;

a seal body for positioning within the wellhead housing and radially within the tensioning mechanism;

a seal body locking member radially movable into engagement with the housing locking member to fix the axial position of the seal body relative to the wellhead housing;

an upper seal assembly for sealing between the seal body and the wellhead housing; and a lower seal assembly for sealing between the seal body and the casing string, such that the casing string is tensioned without appreciable rotation of the hanger body, and the seal body being fluid impermeable from the upper seal assembly to the lower seal assembly.

2. An inner riser adjustable hanger and seal assembly as defined in claim 1, wherein the casing string is tensioned without appreciable rotation of the upper and lower seal assemblies.

3. An inner riser adjustable hanger and seal assembly as defined in claim 1, further comprising:

at least one of an outer surface of the upper end of the casing string and an inner surface of the seal body is tapered; and a setting sleeve moves axially relative to the seal body to move the lower seal assembly into sealing engagement with both the seal body and the upper end of the casing string.

4. An inner riser adjustable hanger and seal assembly as defined in claim 3, further comprising:

at least one shear member for interconnecting the setting sleeve and the seal body; and a detent ring radially movable to allow shearing of the shear member to set the lower seal assembly.

5. An inner riser adjustable hanger and seal assembly as defined in claim 4, further comprising:

a plurality of circumferentially spaced buttons for moving the detent ring radially inward.

6. An inner riser adjustable hanger and seal assembly as defined in claim 3, further comprising:

a radial collapsible detent ring; and one or more shear pins for interconnecting the setting sleeve and the seal body, such that an axial force is transmitted to shear the shear pins to move the detent ring radially inward.

7. An inner riser adjustable hanger and seal assembly as defined in claim 4, further comprising:

a plurality of radially moveable buttons or moving the detent ring into a collapsed position prior to shearing the shear pins.

8. An inner riser adjustable hanger and seal assembly as defined in claim 1, wherein the seal body locking member is a C-ring.

9. An inner riser adjustable hanger and seal assembly as defined in claim 1, further comprising:

a support ring, at least a portion of which is positionable radially inward from and axially moveable relative to the seal body locking member for maintaining the seal body locking member in engagement with the housing locking member.

10. An inner riser adjustable hanger and seal assembly as defined in claim 8, wherein the C-ring is carried on the seal body and is biased radially outward.

11. An inner riser adjustable hanger and seal assembly as defined in claim 1, further comprising:

a centralizing ring positioned at a lower end of the seal body for centralizing the lower end of the seal body relative to the upper end of the casing string.

12. An inner riser adjustable hanger and seal assembly as defined in claim 1, further comprising:

at least one of an outer surface on the seal body and an inner surface on the wellhead housing is tapered; and the upper seal assembly moves axially relative to the wellhead housing from a run-in position to a set position to seal between the seal body and the wellhead housing.

13. An inner riser adjustable hanger and seal assembly for applying tension to a casing string secured at a lower end at a well and supported at an upper end by a wellhead housing, the hanger and seal assembly comprising:

the wellhead housing having one or more grooves on an inner surface thereof;

a tensioning mechanism for tensioning the casing string and securing the upper end of the tensioned casing string to the wellhead housing, the tensioning mechanism including a plurality of axially spaced tension members on an inner surface of a tensioning sleeve fixed to the wellhead housing, the tensioning mechanism axially connecting in tension the casing string to a selected one or more of the plurality of axially spaced tension members such that a desired tension is exerted on the casing string;

a seal body for positioning within the wellhead housing and radially within the tensioning mechanism;

one or more teeth radially movable into engagement with the one or more grooves to fix the axial position of the seal body relative to the wellhead housing;

an upper seal assembly for sealing between the seal body and the wellhead housing; and a lower seal assembly for sealing between the seal body and the casing string, such that the casing string is tensioned without appreciable rotation of the seal body, the upper seal assembly, or the lower seal assembly.

14. A method of applying tension to a casing string secured at a lower end at a well and supported at an upper end by a wellhead housing, the method comprising:

providing the wellhead housing having a housing locking member on an inner surface thereof;

providing a tensioning mechanism for tensioning the casing string, the tensioning mechanism including a plurality of axially spaced tension members on an inner surface of a tensioning sleeve fixed to the wellhead housing, the tensioning mechanism axially connecting in tension the casing string to a selected one or more of the plurality of axially spaced tension members such that a desired tension is exerted on the casing string;

securing the upper end of the casing string to the wellhead housing;

positioning a seal body within the wellhead housing and radially within the tensioning mechanism;

providing a seal body locking member;

radially moving the seal body locking member into engagement with the housing locking member to fix the axial position of the seal body relative to the wellhead housing;

positioning an upper seal assembly between the seal body and the wellhead housing, for sealing therebetween; and positioning a lower seal assembly between the seal body and the casing string, such that the casing string is tensioned without appreciable rotation of the hanger body.

15. A method as defined in claim 14, further comprising:

tensioning the casing string without appreciable rotation of the upper or lower seal assemblies.

16. A method as defined in claim 14, further comprising:

providing at least one of a tapered outer surface of the upper end of the casing string and a tapered inner surface of the seal body;

providing a setting sleeve axially movable relative to the seal body; and axially moving the setting sleeve relative to the seal body to move the lower seal assembly into sealing engagement with both the seal body and the upper end of the casing string.

17. A method as defined in claim 14, further comprising:

providing at least one shear member;

providing at least one detent ring;

interconnecting the setting sleeve and the seal body with the shear member; and selectively radially moving the detent ring to allow shearing of the shear member to set the lower seal assembly.

18. A method as defined in claim 14, further comprising:

providing a support ring;

positioning at least a portion of the support ring radially inward from the seal body locking member; and axially moving the support ring relative to the seal body locking member to maintain the seal body locking member in engagement with the housing locking member.

19. A method as defined in claim 14, further comprising:

providing a centralizing ring; and positioning the centralizing ring at a lower end of the seal body for centralizing the lower end of the seal body relative to the upper end of the casing string.

20. An inner riser adjustable hanger and seal assembly as defined in claim 1, wherein the seal body lands on the wellhead housing before the seal body locking member moves into engagement with the housing locking member.

21. An inner riser adjustable hanger and seal assembly as defined in claim 13, wherein the seal body lands on the wellhead housing before the one or more teeth move into engagement with the one or more grooves on the wellhead housing.

22. An inner riser adjustable hanger and seal assembly as defined in claim 13, further comprising:

at least one of an outer surface of the upper end of the casing string and an inner surface of the seal body is tapered; and a setting sleeve moves axially relative to the seal body to move the lower seal assembly into sealing engagement with both the seal body and the upper end of the casing string.

23. An inner riser adjustable hanger and seal assembly as defined in claim 22, further comprising:

at least one shear member for interconnecting the setting sleeve and the seal body; and a detent ring radially movable to allow shearing of the shear member to set the lower seal assembly.

24. An inner riser adjustable hanger and seal assembly as defined in claim 22, further comprising:

a radial collapsible detent ring; and one or more shear pins for interconnecting the setting sleeve and the seal body, such that an axial force is transmitted to shear the shear pins to move the detent ring.

25. An inner riser adjustable hanger and seal assembly as defined in claim 13, wherein the seal body locking member is a C-ring.

26. An inner riser adjustable hanger and seal assembly as defined in claim 13, further comprising:

a support ring, at least a portion of which is positionable radially inward from and axially moveable relative to the seal body locking member for maintaining the seal body locking member in engagement with the housing locking member.

27. An inner riser adjustable hanger and seal assembly as defined in claim 13, further comprising:

a centralizing ring positioned at a lower end of the seal body for centralizing the lower end of the seal body relative to the upper end of the casing string.

28. An inner riser adjustable hanger and seal assembly as defined in claim 13, further comprising:

at least one of an outer surface on the seal body and an inner surface on the wellhead housing is tapered; and the upper seal assembly moves axially relative to the wellhead housing from a run-in position to a set position to seal between the seal body and the wellhead housing.

29. An inner riser adjustable hanger and seal assembly as defined in claim 13, wherein the seal body is fluid impermeable from the upper seal assembly to the lower seal assembly.

* * * * *